US005287829A

United States Patent [19]

Rose

[11] Patent Number: 5,287,829

[45] Date of Patent: Feb. 22, 1994

[54] FLUID ACTUATORS

[76] Inventor: Nigel E. Rose, 5 Woodvale Drive, Mudgeeraba, Queensland 4213, Australia

[21] Appl. No.: 835,911

[22] PCT Filed: Aug. 28, 1990

[86] PCT No.: PCT/AU90/00387

§ 371 Date: Feb. 26, 1992

§ 102(e) Date: Feb. 26, 1992

[87] PCT Pub. No.: WO91/03630

PCT Pub. Date: Mar. 21, 1991

[30] Foreign Application Priority Data

| | | | |
|---|---|---|---|
| Aug. 28, 1989 | [AU] | Australia | PJ5992 |
| Aug. 28, 1989 | [AU] | Australia | PJ5993 |
| Sep. 11, 1989 | [AU] | Australia | PJ6283 |
| Oct. 13, 1989 | [AU] | Australia | PJ6839 |
| Nov. 22, 1989 | [AU] | Australia | PJ7516 |
| Dec. 28, 1989 | [AU] | Australia | PJ8028 |

[51] Int. Cl.[5] ..... F01L 9/02; F02M 47/04; F15B 9/08; F15B 15/20

[52] U.S. Cl. ..... 123/90.12; 123/197.1; 251/30.04; 251/63.5; 92/175; 239/533.3; 239/585.1

[58] Field of Search ..... 251/30.01, 30.04, 63.5; 91/329, 395; 92/175; 239/533.3, 533.8, 585.1; 123/90.12, 90.11, 90.13, 90.14, 197.1, 197.3, 197.4

[56] References Cited

U.S. PATENT DOCUMENTS

| | | | |
|---|---|---|---|
| 3,844,528 | 10/1974 | Massie | 251/30.04 |
| 4,293,287 | 10/1981 | Carrens | 91/329 |
| 4,767,282 | 8/1988 | Igarashi et al. | 91/329 |
| 4,830,331 | 5/1989 | Vindum | 251/63.5 |
| 4,899,700 | 2/1990 | Richeson, Jr. et al. | 123/90.14 |
| 4,974,495 | 12/1990 | Richeson, Jr. | 123/90.12 |
| 5,022,358 | 6/1991 | Richeson | 251/63.5 |

FOREIGN PATENT DOCUMENTS

| | | |
|---|---|---|
| 245000 | 11/1960 | Australia . |
| 974942 | 6/1961 | Fed. Rep. of Germany . |
| 448755 | 4/1968 | Switzerland . |

*Primary Examiner*—E. Rollins Cross
*Assistant Examiner*—Weilun Lo
*Attorney, Agent, or Firm*—Bauer & Schaffer

[57] ABSTRACT

A fluid actuator (10) including a chamber (14) in which a piston assembly (17) reciprocates. The piston assembly (17) includes a pair of spaced pistons (18, 19) which divide the chamber (14) into three sections (20, 21, 22) and a passageway (29) which supports a valve member (30). Reciprocating movement of the slide valve member (30) causes fluid to be directed to the chamber sections (20) and (22) and thereby corresponding reciprocating movement of the piston assembly (17). The actuator (10) may be applied to the control of any device such as valves of internal combustion engines, fuel injectors or comprise actuating means for the piston of an internal combustion engine.

24 Claims, 13 Drawing Sheets 30
11

30
36
35
20
25
26
21
22
34
38
39
32
31

30
17
27
37

30
25
35
26
32
24
34
22
38
39
40
36
20
18
14
27
11

30
36
35
25
20
17
24
34
22
16
23
14
26
19
11

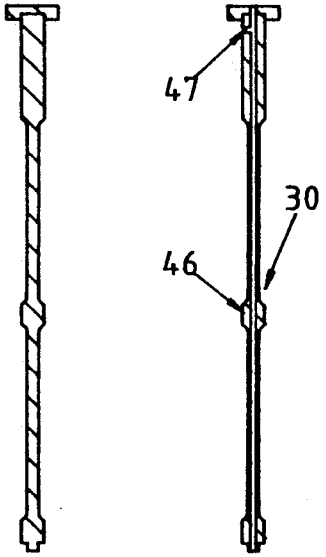
FIG.12
FIG.11
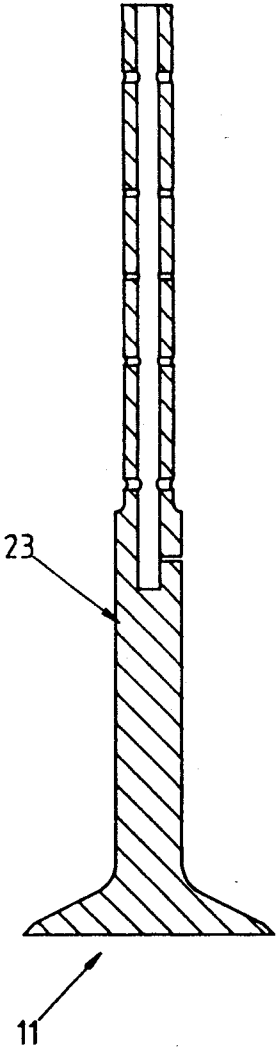
FIG.10
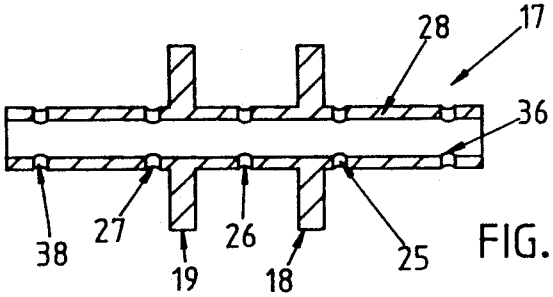
FIG.7
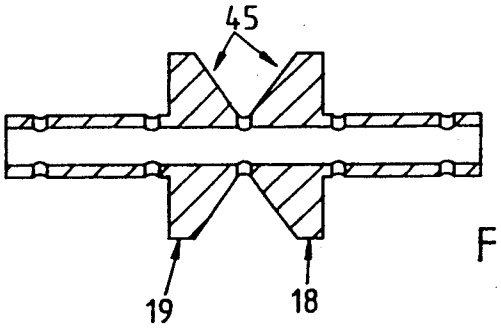
FIG.8
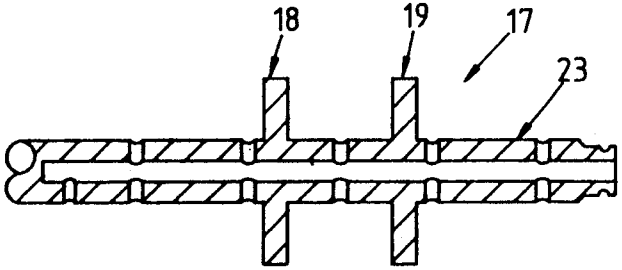
FIG.9

FLUID ACTUATORS

TECHNICAL FIELD

This invention relates to fluid actuators which in one particular aspect are applicable to the control of various mechanisms in internal combustion engines, for example exhaust and inlet valves or fuel injectors and which in a further aspect are applicable to the extraction of power from reciprocating pistons of internal combustion engines. The actuators of the invention however may be applied to other situations for example as servomechanisms or for accurate control of movement.

BACKGROUND ART

Conventional internal combustion engines are provided with a number of different operating mechanisms for controlling inlet and outlet valves for the engine cylinders or in the case of fuel injected engines for controlling the injectors. Usually such mechanisms take the form of cam shafts, rockers, return springs or other mechanical actuating elements. Such mechanism suffer a number of disadvantages and limitations including in the case of valved engines poor valve cooling, poor lubrication, a lack of ability to maintain alignment of the valves with their seats, poor control over movement of the valve and an excessive amount of power which is required to overcome the valve seating springs.

Particular disadvantages associated with fuel injectors include lack of flexibility of injection timing, excessive mechanical components in the injector drive train, an excessive amount of power wastage in operating the injectors and their drive train and a lack of ease of assembly and removability of the injectors and associated drive train from the engine during maintenance.

Conventional internal combustion engines usually also include reciprocating pistons which are coupled to a crank shaft via piston rods, however, this form of mechanical connection has limitations resulting in limitation of transmission of usable energy from the piston to the crank shaft caused by changes of the lever arm at the crank shaft from zero at the start of the stroke through a maximum at approximately half stroke to zero at the end of the stroke. Further disadvantages arise because of side thrust friction losses causing cylinder and piston wear induced by thrust angles of the connecting rods relative to the cylinder bore centre line during rotation of the crank shaft. Lack of flexibility in the control of the rate of expansion of the gases of combustion also occurs due to utilization of a rotating crank shaft rigidly attached to the reciprocating pistons by connecting rods consequently leading to a considerable loss in the recovery of usable energy from the gases of combustion.

SUMMARY OF THE INVENTION

The present invention aims to provide a fluid actuator which may be applied to the many different applications where accurate control of movement is required. In one application, the fluid actuator of the invention may be used for the control of the inlet and exhaust valves of internal combustion engines so as to give increased control over movement of the valve and allowing for variable timing of the valve operating cycle. The present invention also aims to provide an arrangement which in the latter application reduces the reciprocating mass of the valve operating mechanism and reduces the rate of wear of the valve and its guides whilst increasing valve cooling and obtaining improved control over valve alignment with their seats. The present invention also aims to provide an actuator which when applied to the operation of fuel injectors enables simple control of injection timing, reduces the mass of injector drive train, which decreases the power required to operate the injectors and improves ease of assembly and disassembly of the injectors and their drive train to and from the engine.

In its applicability to the extraction of usable energy from the reciprocating pistons of internal combustion engines the present invention provides an actuator which permits greater recovery of usable energy, reduces side thrust friction losses and consequent rates of cylinder tear and provides a degree of flexibility to control the rate of expansion of the gases of combustion.

With the above and other objects in view the present invention provides a fluid actuator including a chamber, a piston assembly arranged for reciprocating movement within said chamber, said piston assembly including first and second spaced apart pistons dividing said chamber into at least a first chamber section between said first piston and said chamber and a second chamber section between said first and second pistons, passageway means in said piston assembly, fluid inlet means communicating with said second chamber section and valve means for controlling the flow of fluid through said passageway means, said valve means be operable to communicate through said passageway means said first and second chamber sections so as to cause movement of said piston assembly in a first direction, said valve means being further operable to vent fluid from said first chamber section whereby to permit said piston assembly to move in a direction opposite said first direction.

Preferably, said piston assembly defines between said second piston and said chamber a third chamber section, and said valve means is operable to communicate through said passageway means said second and third chamber sections so as to cause said piston assembly to move in said direction opposite said first direction.

Most preferably, said piston assembly includes first, second and third port means communicating with said first, second and third chamber sections respectively and said valve means controls communication between said port means and said passageway means. The piston assembly suitably includes opposite portions extending beyond opposite ends of said chamber, and vent port means in said opposite portions and adapted for communication with said passageway means, said valve means being adapted to control communication of said vent port means with said first and third port means whereby to control venting of said first and third chamber sections.

Preferably, said passageway extends longitudinally of said piston assembly and said valve means is slidable in said passageway. Suitably, said valve means includes a plurality of lands, said lands being adapted to open and close said port means to control communication thereof with said passageway. Preferably, said lands are separated by annular grooves defining fluid paths in said passageway.

Means are suitably provided for reciprocating said valve means such that movement of said valve means in said first direction opens communication between said first and second port means and said passageway, and opens communication between said third port means and vent port means through said passageway, to cause said movement of said piston assembly in said first direction.

Preferably, movement of said valve means in said opposite direction opens communication between said second and third port means and said passageway and opens communication between said first port means and vent port means through said passageway to cause movement of said piston assembly in said opposite direction.

The actuator may also include further chamber sections communicating with the respective said vent port means and isolating vented fluid.

In a further form, the actuator includes biasing means for opposing movement of said piston assembly in said first direction. Suitably, said biasing means acts on said second piston and comprises spring means disposed between said second piston and wall means at the other end of said chamber.

The present invention also provides the combination of a fluid actuator as described above and a valve of an internal combustion engine, said piston assembly of said actuator being coupled to said engine valve and wherein movement of said operation of said valve means is adapted to cause opening and closing movement of said valve. Suitably, said engine valve includes a valve stem, said piston assembly being secured to or formed integrally with said stem and said passageway being disposed within said stem.

The present invention further provides the combination of a fluid actuator as described above and a fuel injector having a reciprocatory plunger, said piston assembly of said actuator being coupled to said plunger and being adapted to reciprocate said plunger upon operation of said valve means.

In a further form the present invention provides an internal combustion engine comprising a piston arranged for reciprocation in a cylinder and a fluid actuator as described above, said piston assembly of said actuator being coupled to said engine piston and wherein operation of said valve means causes reciprocation of said piston assembly and said engine piston.

Preferably, said valve means is operated by cam means, rotation of said cam means causing reciprocation of said valve means and said piston assembly.

Means may also be provide for varying the stroke of said engine piston or compression ratio of said engine by selectively repositioning the cam means.

BRIEF DESCRIPTION OF THE DRAWINGS

Reference will now be made to the accompanying drawings which illustrate a preferred embodiment of the invention and wherein:

FIG. 7 is a sectional view showing one form of piston of the actuator;

FIGS. 8 and 9 illustrate in sectional view further form of pistons for use in the actuator;

FIG. 10 is a longitudinal sectional view of an engine valve modified for use with the actuator of the present invention;

FIGS. 11 and 12 illustrate in elevational view preferred forms of slide valves for controlling the actuator;

BEST MODE FOR CARRYING OUT THE INVENTION

Figure 1:
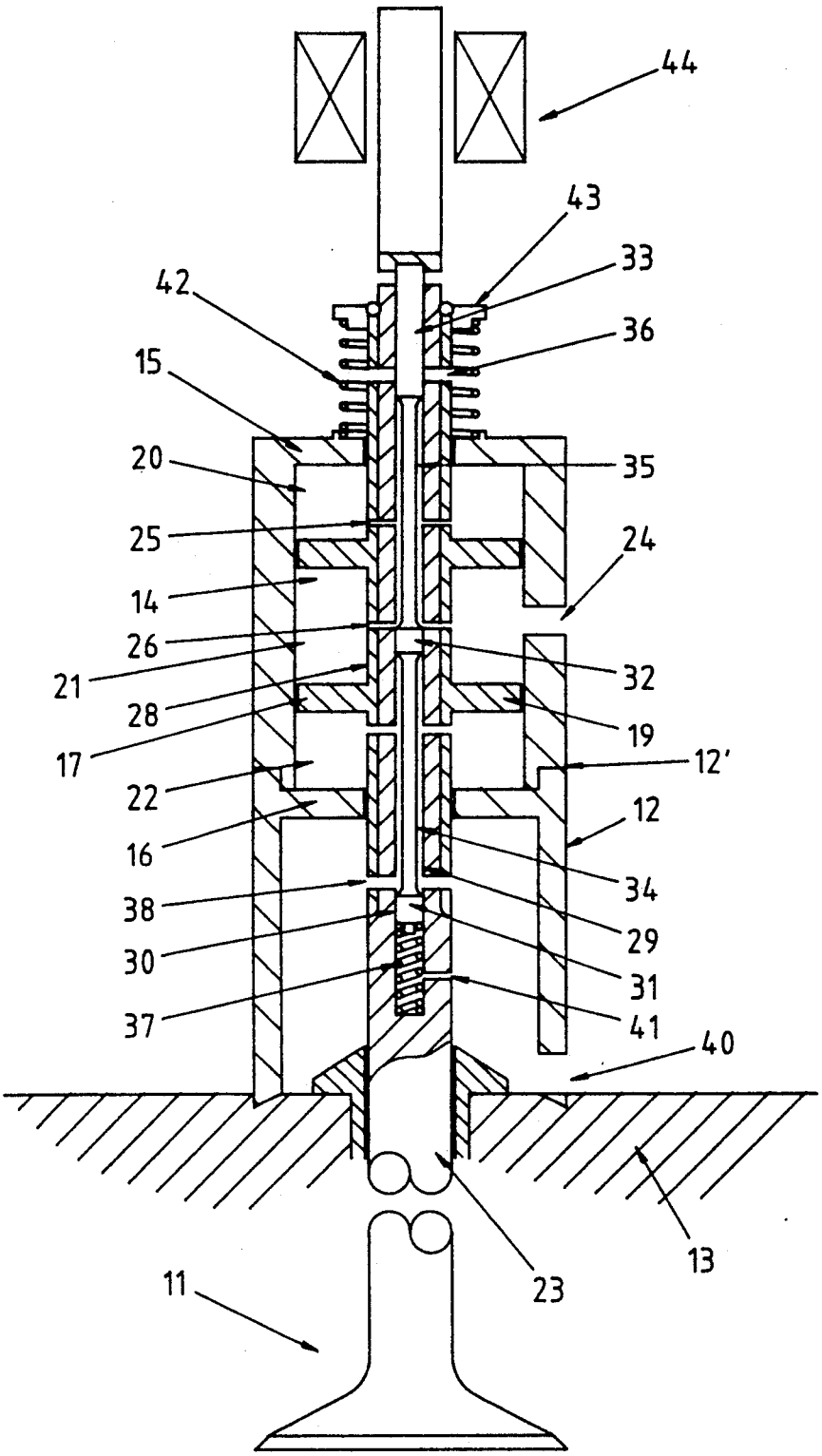
FIG. 1 is a somewhat pictorial longitudinal sectional view of a fluid actuator according to the present invention applied to the control of inlet or outlet valves of an internal combustion engine.

Referring to the drawings and firstly to FIG. 1 there is illustrated a fluid actuator 10 according to the present invention adapted for the control of a valve 11 of an internal combustion engine, for example an inlet or exhaust valve. The actuator 10 includes a housing 12 of generally cylindrical form which is mounted to the head 13 of an engine and which includes a cylindrical chamber 14 defined between an end wall 15 of the housing 12 and intermediate annular wall 16.

Arranged for reciprocation within the chamber 14 is a piston assembly 17 which includes a pair of spaced apart annular pistons 18 and 19 which separate the chamber 14 into three chamber sections 20, 21 and 22. The valve 11 includes a valve stem 23 which is secured to the piston assembly 17 for movement therewith. Alternatively the piston assembly 17 may be formed integrally with the valve stem 23. An inlet port 24 is provided in the wall of the housing 12 for the supply of hydraulic fluid to the chamber section 21.

The piston assembly 17 includes a series of ports 25, 26 and 27 provided in its annular shaft 28 to communicate with the respective chamber sections 20, 21 and 22 and through the stem 23 with a longitudinally extending internal bore 29 formed within the shaft 28 or stem 23 of the valve 11. Supported for reciprocation within the bore 29 is a slide valve member 30 which includes spaced lands 31, 32 and 33 separated by annular grooves 34 and 35 which define passageways for hydraulic fluid. Discharge ports 36 are provided at the upper end of the piston assembly 17 to communicate with the bore 29 whilst at the lower end of the bore 29 a spring 37 is provided to urge the valve 33 to an upper position. Further discharge ports 38 are also provided in the shaft 28 at the lower end of the piston assembly 17 to communicate through the stem 23 with the bore 29. The ports 38 preferably extend in a non-radial direction outwardly from the bore 29 so that liquid discharging therefrom causes an off centre force to be applied to the valve stem 23 and rotation of the valve 11 so as to ensure even wearing on the valve seat.

The lower part of the housing 12 beneath the wall 16 forms a drainage chamber 39 which vents through drainage ports 40. Further drainage ports 41 communicate with the bore 29 in the region of the spring 37 to vent this portion of the bore 29.

Optionally, a return spring 42 acting between a flange 43 secured to the valve stem 23 and the end wall 15 of the housing 12 may be provided to normally hold the valve 11 in a closed position. Operation of the slide valve member 30 may be controlled by a solenoid 44 which has its armature connected to, or integral with the valve member 30, or alternatively a conventional rotational cam and cam shaft acting directly or indirectly on the valve member 30.

Figures 2, 3, 4, 5, 6:
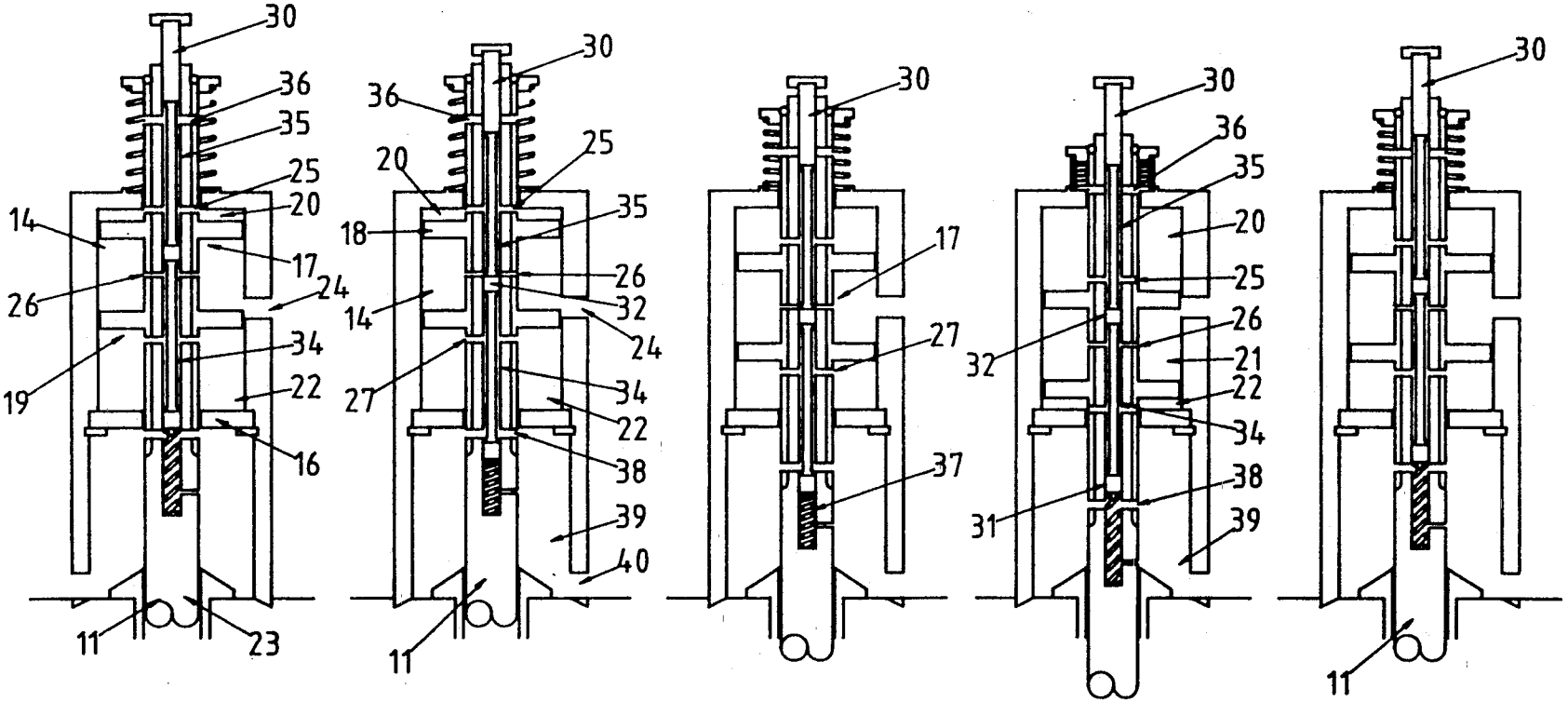
FIGS. 2 to 6 illustrate various stages of the operation of the actuator.

In use and as shown in FIGS. 2 to 6 the piston assembly 17 when the valve 11 is seated is moved to a raised position under the influence of hydraulic fluid supplied through the port 24 passing into the port 26 through the annular groove 34 to the chamber section 22 to act between the piston 19 and wall 16. In this position also the slide valve member 30 is held in a raised position. Fluid in the chamber section 20 communicates through the ports 25, annular groove 35 and ports 36 to drain. So as to open the valve 11, the slide valve member 30 is advanced by the solenoid 44 (or a cam) as shown initially in FIG. 3 so that the land 32 blocks the passage of fluid from the inlet 24 to the chamber section 22. At the same time, fluid communication from the port 24 is opened through the ports 26, groove 35 and port 25 to the upper section 20 of the chamber 14, with the land 33 blocking its passage to the vent ports 36, whilst the lower chamber section 22 is vented through the ports 27, groove 34 and port 38 to the drainage chamber 39 and through port 40 to drain. The fluid in the chamber section 20 acting between the piston 18 and housing end wall 15 causes downward movement of the piston assembly 17 and thus opening movement of the valve 11. At the same time the slide valve member 30 is moved downwardly at the same rate by the solenoid 44 as shown in FIG. 4. It will be seen that during this motion the return spring 37 for the valve member 30 and return spring 42 for the valve 11 (if used) will be compressed.

When the valve 11 approaches a fully opened position, the valve member 30 is stopped in its movement as shown in FIG. 5 so that the land 32 blocks communication of the port 26 with the chamber section 20 and at the same time the land 31 blocks communication of the chamber section 22 with the drainage chamber 39. The chamber section 20, however, is opened to vent through the ports 25, passage 35 and ports 36, whilst the chamber 21 communicates through the ports 26, and passage 34 to the chamber section 22.

As fluid is supplied to the chamber section 22 through ports 26, passageway 34 and ports 27 whilst being vented from the chamber 20 through ports 25, passageway 35 and ports 36, the piston assembly 17 raises upwardly thereby moving the valve 11 again towards a closed position. At the same time, the slide valve member 30 is also retracted as shown in FIG. 6 so that the valve 11 and slide valve member 30 move upwards at the same rate until the valve 11 is closed and the slide valve member 30 moved to the position of FIG. 2. The piston assembly 12 is thus slaved to reciprocating movement of the slide valve member 30.

The inlet port 24 is preferably fitted with a non-return valve so as to preclude the possibility of valve bounce in the event of engine overspeed or the operation of an engine with excessively low hydraulic pressure supply. In most cases, hydraulic fluid to the inlet port 24 is supplied as the existing lubrication oil in an engine pressurised by a conventional oil pump. To increase pressure in the hydraulic supply however, the normal oil pump may be replaced by a pump with increased capacity or an auxiliary pump may be provided for direct supply of fluid sometimes other than lubrication oil to the inlet port 24. The housing 12 for assembly and disassembly purposes is preferably formed into at least two parts separable or joinable at the position 12' by an connection arrangement known in the art.

FIG. 7 illustrates in sectional view the preferred form of piston assembly 17 which comprises a component separate from the valve stem 23. The piston assembly 17 however may have the alternative form shown in FIG. 8 where the respective pistons 18 and 19 have frustoconical opposing faces 45 to facilitate the transfer of hydraulic fluid into the port 26.

FIG. 9 illustrates in sectional view, a valve stem 23 having the piston assembly 17 and thus pistons 18 and 19 formed integrally therewith.

FIG. 10 illustrates the modified engine valve 11 formed in accordance with the present invention for use in association with the piston assembly 17 of FIG. 7 whilst the slide valve member 30 is suitably of the cross sectional form shown in FIG. 11. In the embodiment of FIG. 12 however, the valve member 30 includes a longitudinally extending bore 46 which extends through the end of the valve 30 or communicates with a radially extending port 47 to vent the portion of the bore 35 containing the spring 37. In this arrangement, of course, the vent port 41 may be eliminated.

Figure 13:
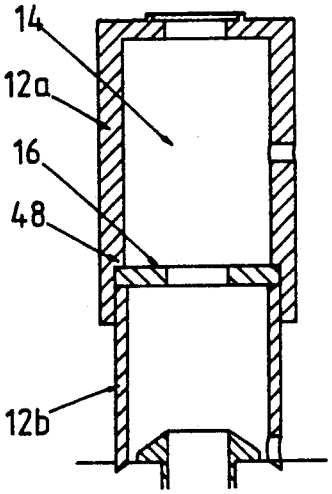
FIGS. 13 to 15 illustrate in sectional view alternate forms of housings for the actuator.
Figure 14:
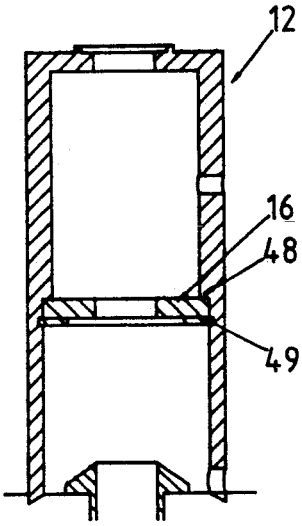
Figure 15:
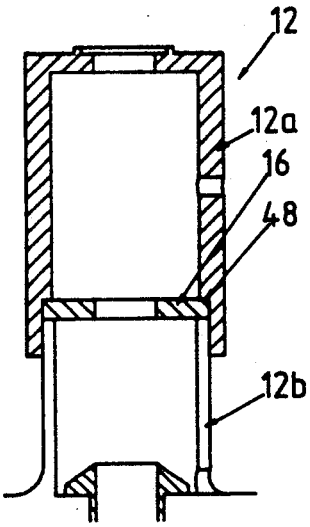

The housing 12 as shown in FIG. 1 may also be constructed in any of the forms shown in FIGS. 13 to 15. In FIG. 13, the housing 12 includes a top part **12*a* and a bottom part 12*b* defining the annular wall 16, the part 12*a* having an internal shoulder 48 against which the part 12*b* abuts. Preferably the parts 12*a* and 12*b* are pressed and held together by any suitable mounting means or clamp securing the housing to the engine head 13. In FIG. 14, the housing 12 is in one part however the annular wall 16 is of washer-shaped form and held against the shoulder 48 by a circlip 49 or like connector. In FIG. 15, the housing 12 is again in two parts 12*a* and 12*b* with the annular wall 16 in this embodiment being a separate washer like part held against the shoulder 48 by the housing part 12*b***.

Figure 16A:
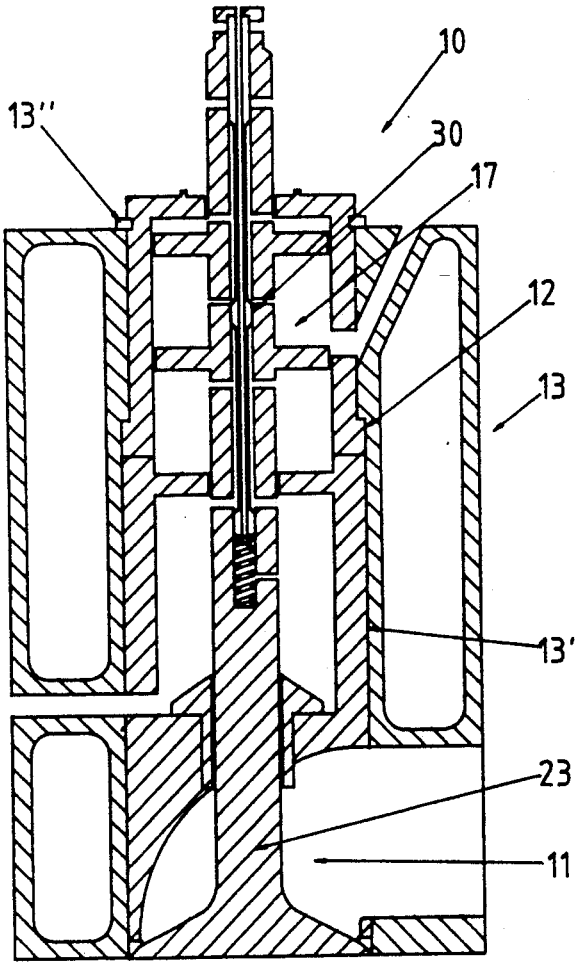
FIGS. 16A and 16B are a sectional views showing alternative arrangements for mounting the actuator in the head of an engine.
Figure 16B:
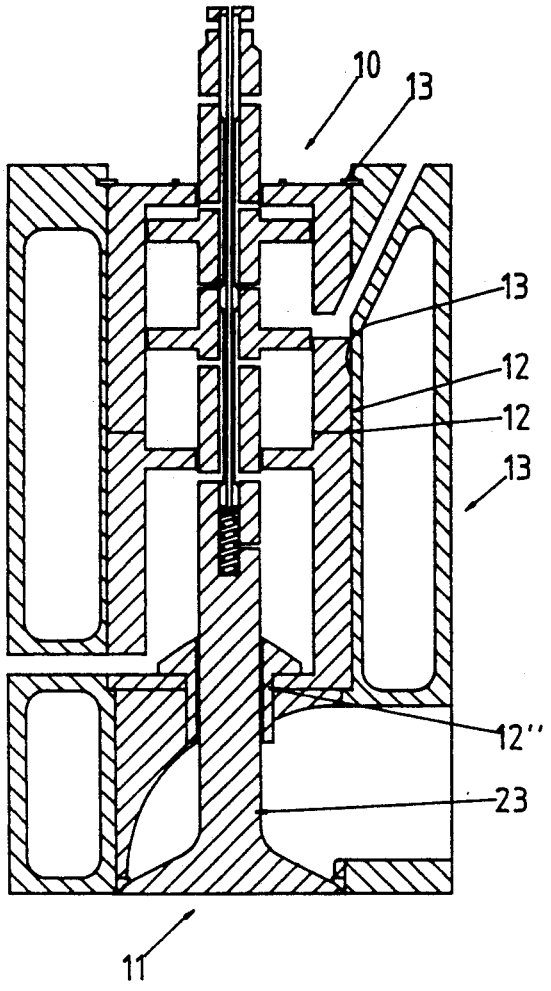
Figure 17:
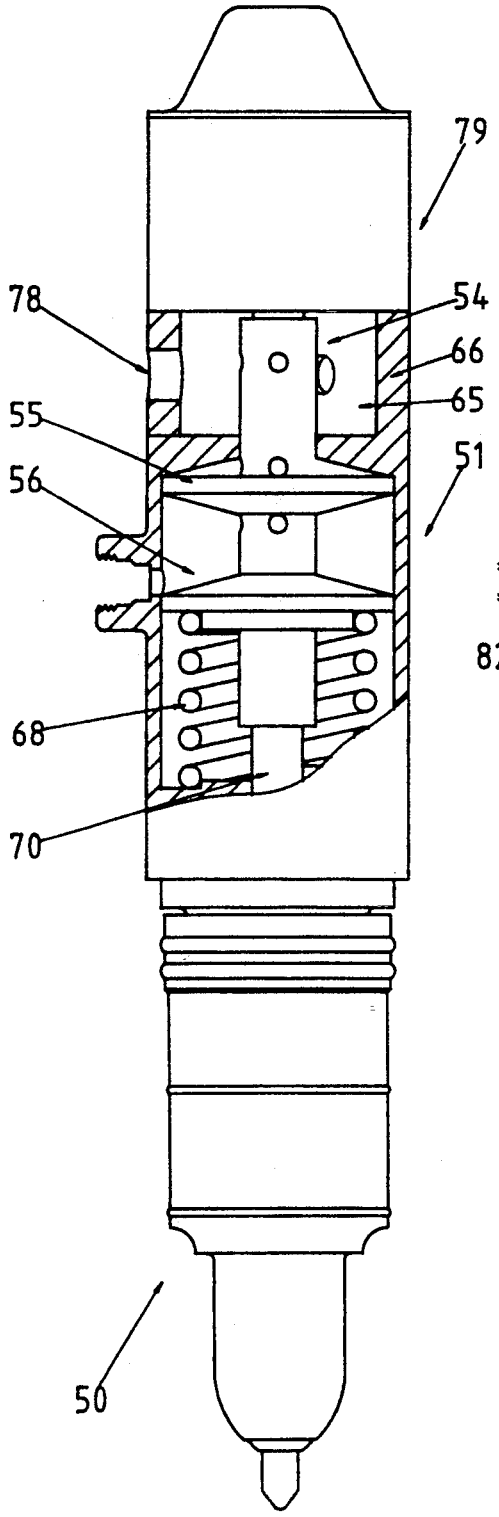
FIG. 17 illustrates in part cut-away view the application of the actuator of the invention to the control of a fuel injector.

In the embodiment of FIGS. 16A and 16B, the actuator is arranged within the head 13 of a engine and like parts of the actuator of FIG. 1 have been given like numerals in FIGS. 16 and 17. The housing 12 in both instance may be split longitudinally to facilitate assembly and disassembly of the unit and its placement within the head 13. In FIG. 16A, the housing 12 is placed into the head 13 from the lower side being located within a stepped bore 13' within the head 13 to mate therewith and be held in place by a circlip 13". In the arrangement of FIG. 16B, the housing 12 is inserted into the bore 13' from the top side of the head 13 to be again held in position by the circlip 13". In either case the housing 12 may be split as at 12' and 12" to facilitate assembly.

The timing of the opening and closing of the valve 11 may be simply controlled by varying the timing of operation of the solenoid 44 which can be microprocessor controlled. The above described arrangement also eliminates mechanical valve drive trains and permits infinitely variable valve timing and duration of lift. The arrangement also provides the possibility of decompressing individual cylinders or groups of cylinders so as to give lighter cranking loads during engine start up procedures. Simplified alteration of the valve timing also permits the starting of engines by direct air injection into a cylinder and the facilitating of an engine braking capacity. Overall, a simplified lighter engine with fewer wearing parts results.

Figure 18:
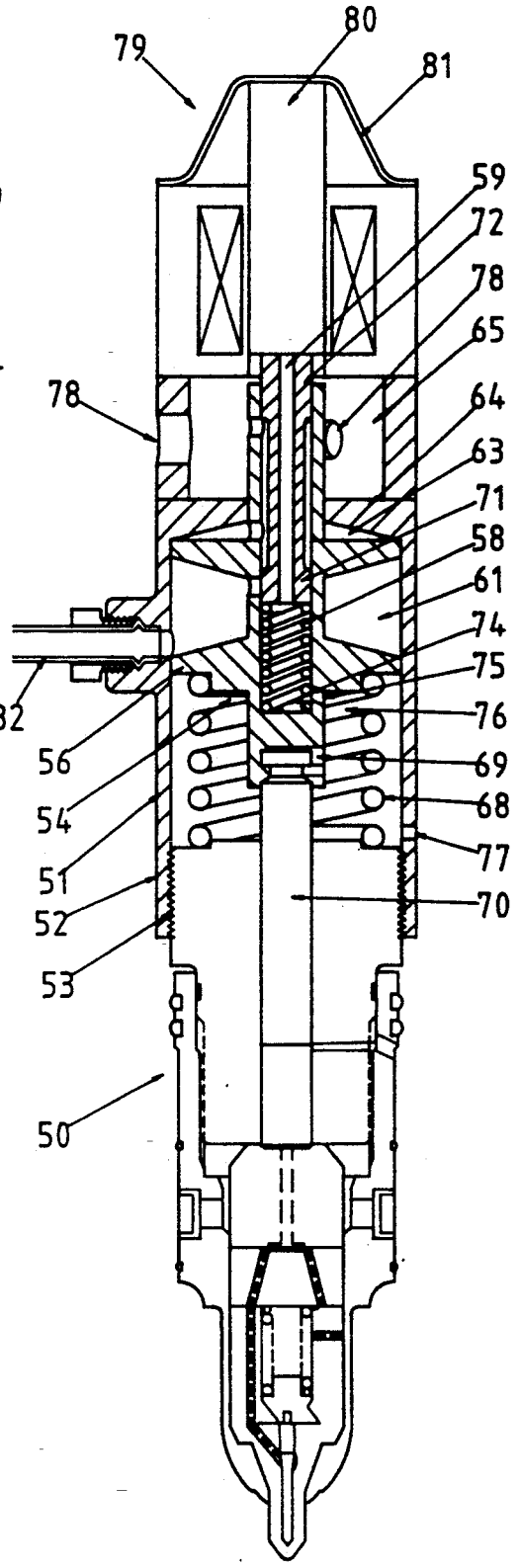
FIG. 18 is a longitudinal sectional view showing the actuator and fuel injector of FIG. 17.
Figure 19:
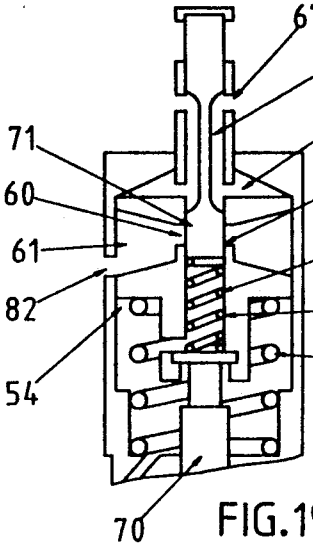
FIGS. 19 to 23 illustrate the cycle of operate on of the actuator as applied to fuel injectors.

Referring now to FIGS. 17 and 18 there is illustrated a fuel injector 50 which is arranged to be driven by a fluid actuator 51 according to the present invention which in this aspect is a single acting actuator. The actuator 51 includes a cylindrical chamber 52 which is mounted to the injector 50 through a connection 53 which may comprise a threaded or any other connection and which supports a reciprocating piston assembly 54. The piston assembly 54 includes a pair of spaced apart pistons 55 and 56 mounted on or formed integrally with a hollow sleeve 57 which defines a bore 58 for receiving a slide valve member 59. Ports 60 communicate the region between the pistons 55 and 56 which comprises a supply chamber 61 with the bore 58 whilst further ports 62 communicate the region above the piston 55 which comprises a working chamber 63 with the bore 58, the chamber 63 being defined between the piston 55 and an annular wall 64 extending transversely of the chamber 52. A vent chamber 65 is formed above the wall 64 being defined by an annular spacer 66 and further ports 67 formed in the sleeve 57 communicate the chamber 65 with the bore 58. A return spring 68 extends between the piston 56 and injector 50 to normally bias the piston assembly 54 to the raised attitude shown. The piston assembly 54 is also positively coupled at 69 to the plunger 70 of the injector 50.

The slide valve member 59 includes a pair of spaced lands 71 and 72 separated by an annular groove 73 and a return spring 74 located in the lower end of the bore 58 normally biases the slide valve member 59 upwardly to the position shown in FIG. 18. A bore 75 opening to the top of the assembly or optionally a vent 75' communicating with the bore 75 vents the lower end of the bore 58 (containing the spring 74) in the latter case to a lower chamber section 76 which contains the return spring 68 with that chamber itself being vented through ports 77. The upper vent chamber 65 is also vented through a port or ports 78 and the lower edges of each port 77 and 78 act as weirs so that operating fluid is always maintained in the respective chambers 65 and 76 for lubrication purposes. The slide valve member 59 is coupled to a double acting solenoid 79 which includes an armature 80 whose upward movement is restricted by a cap 81. Hydraulic fluid is supplied to the chamber section 61 through a supply port 82 which is connected to any suitable supply of hydraulic fluid.

In use and as shown in FIGS. 19 to 23 the return springs 74 and 68 initially maintain the slide valve member 59 and piston assembly 54 in a raised attitude and the injector plunger 70 retracted. Hydraulic fluid supplied through the supply port 82 of the chamber 61 is blocked from passage through ports 60 by the land 71, whilst the working chamber 63 is vented via the ports 62, groove 73 and ports 67.

Figure 20:
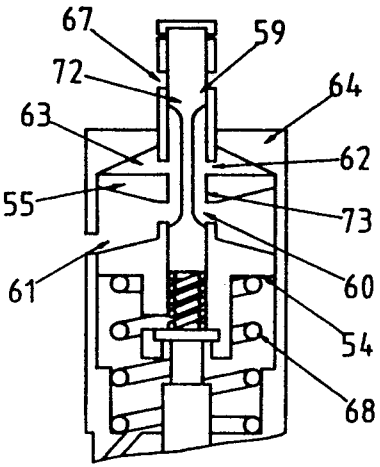
Figure 21:
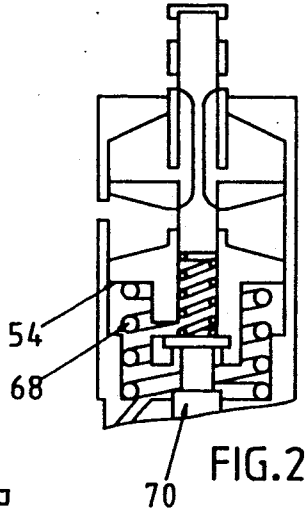

Initial actuation of the solenoid 79 causes the slide valve member 59 to be advanced as shown in FIG. 20 so that the land 72 blocks the ports 67 whilst the land 71 opens the ports 60 so that fluid may pass from the supply chamber 61 through the groove 73, and ports 62 into the working chamber 63. This fluid working between the piston 55 and wall 64 causes the piston assembly 54 to be advanced against the force of the spring 68 as shown in FIG. 21 causing the injector plunger 70 to operate and apply a charge of fuel into an engine cylinder.

Figure 22:
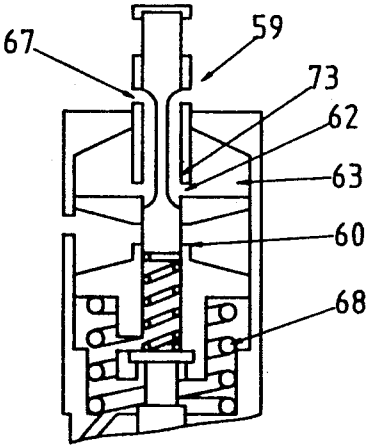
Figure 23:
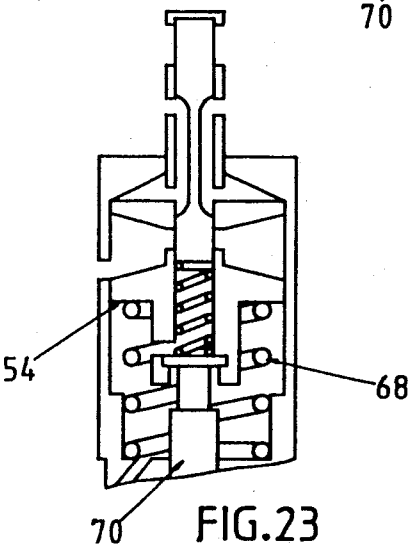

Reversing of the solenoid 79 will cause retraction of the slide valve 59 as shown in FIG. 22 so that the ports 60 are blocked thereby preventing further fluid passing into the working chamber 63 whilst chamber 63 is vented via the ports 62, groove 73 and ports 67. The compressed spring 68 will thus cause the piston assembly 54 to retract as shown in FIG. 23.

The stroke of the plunger 70 is thus governed by the extent of movement of the armature 80 of the solenoid 79 so that the amount of fuel supplied by the injector on each stroke can be selectively varied and its rate of injection controlled by varying the power supplied to the solenoid. Alternatively, the plunger 70 of the injector may be operated at its full stroke at all times and the fuel metered by a spill port under the control of a solenoid operated valve ducted from the injector high pressure fuel chamber.

Figure 25:
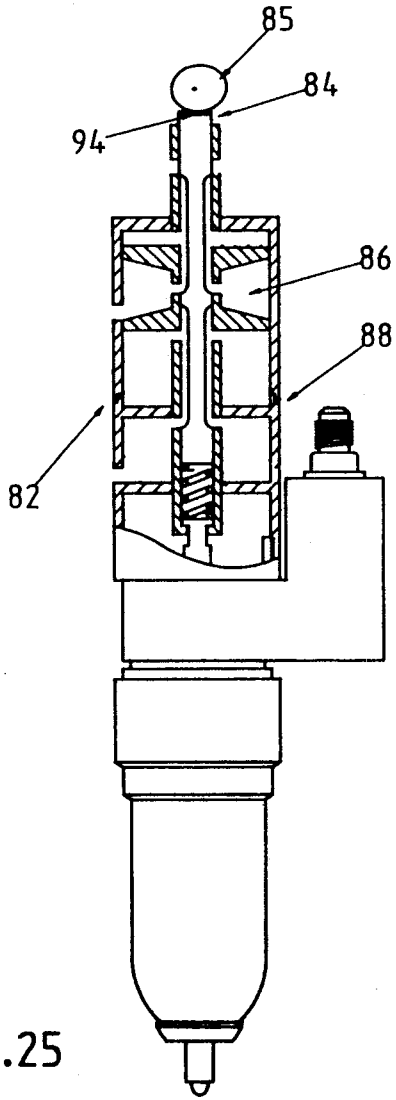
FIGS. 24 and 25 illustrate in cut-away and part-sectional view respectively an alternative actuator/injector combination.
Figure 24:
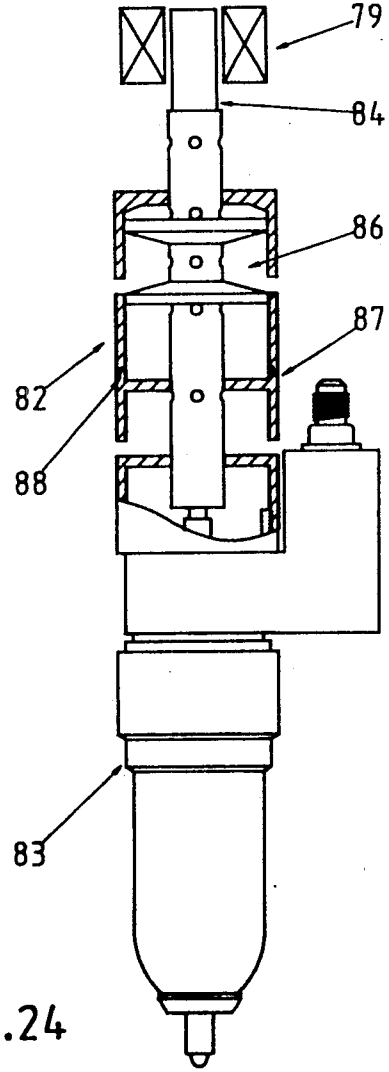

FIGS. 24 and 25 illustrate an alternative form of actuator 82 coupled to a fuel injector 83, the actuator 82 in this instance being of the same form as that shown in FIG. 1 operating in double acting mode and in the same fashion as described in FIGS. 2 to 6. In the arrangement of FIG. 24, the slide valve member 84 is controlled by a solenoid 79 as described previously however alternatively and as shown in FIG. 25, the slide valve member 84 may be reciprocated by a rotatable cam 85 to cause opposite reciprocating movement of the piston assembly 86 of the actuator 82. So as to enable assembly and disassembly of the actuator 82, the chamber housing 87 is suitably split at 88 to enable the piston assembly 86 to be removed from the housing 87. The split 88 may be defined by a threaded connection or any other suitable sealed connection.

Figure 26:
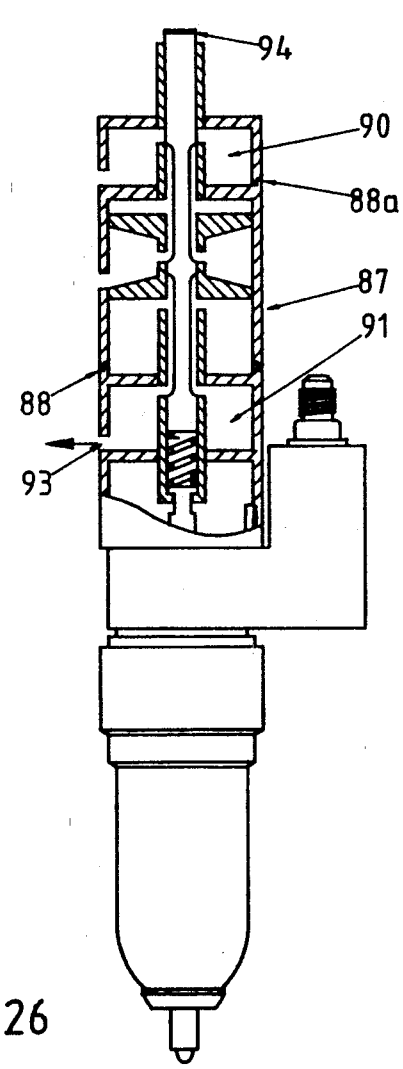
FIG. 26 is a partly cut away view showing a modification to the actuator and injector combination of FIGS. 19 and 20.

In the embodiment of FIGS. 24 and 25, the fluid vented from the actuator at 89 freely mixes with the lubrication fluid or oil of the engine. However, to isolate the actuator operating fluid, the actuator 82 may be modified as shown in FIG. 26 for use say in situations where the injector is located externally of the engine. In this instance two further chambers 90 and 91 are provided within the housing 87 to act as vent chambers for the collection of vented operating fluid. These chambers 90 and 91 are provided with respective outlet ports 92 and 93 which may be interconnected with a manifold and isolate the fluid returning to drain from cross contamination or loss when recycling. Again the housing 87 is split, in this instance at three positions 88, 88*a* and 88*b* to facilitate assembly and disassembly of the actuator.

The slide valve member 84 in the above embodiments and where a cam 85 is used to control its reciprocation may include an end cap or shim 94 which may be made of varying thickness for varying the clearance/stroke of the valve member 84. Alternatively, this of course can be achieved through variations of the profile of the cam 85.

Application of the actuator of the invention to the control of fuel injectors has a number of advantages permitting individual control of the injectors during engine operation giving more even power development by the engine and also permitting variable injection pressures to suit different fuels and different environmental conditions. Individual injectors may be isolated for reduced power operations and infinitely variable injection timing is possible using microprocessor controls.

Both valve and injector assemblies as described above may be combined in an engine giving a much simpler two or four stroke engine due to the elimination of many parts. Such an engine may be readily controlled for direct reversing to suit various situations.

Figure 27:
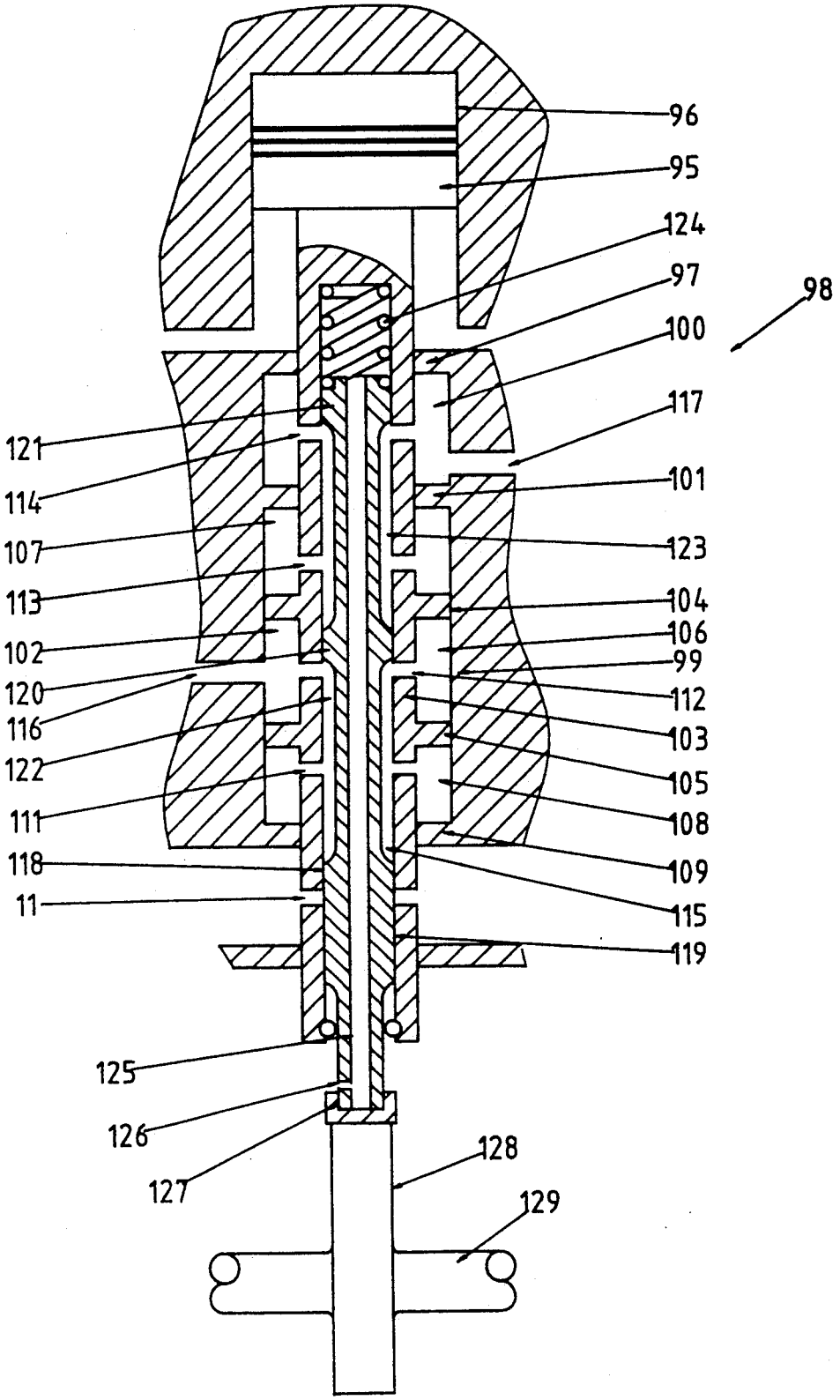
FIG. 27 illustrates the actuator of the present invention associated with a piston of an internal combustion engine.

Referring now to FIG. 27 there is illustrated an application of the actuator of the invention to the extraction of energy from a reciprocating piston. As shown schematically a piston 95 reciprocates in a cylinder 96 of an internal combustion engine which may comprise a spark ignition engine or a compression ignition engine and be operated either as a four cycle or two cycle engine and for this purpose incorporates means for the supply of fuel and the removal of exhaust products.

Mounted in line with the cylinder 96 but separated therefrom by a partition 97 is a housing 98 which defines a cylindrical operating chamber 99 and a vent chamber 100 separated by a wall 101. Mounted within the housing 98 is a piston assembly 102 which includes a hollow tubular piston rod or sleeve 103 having mounted thereon or formed integrally therewith a pair of pistons 104 and 105 which are arranged for reciprocation within the chamber 99 and divide the chamber 99 into a supply section 106 between the pistons 104 and 105 and opposite end sections 107 and 108 between the piston 104 and wall 101, and piston 105 and a further end wall 109 of the housing 98. The sleeve 103 includes a series of ports 110, 111, 112, 113 and 114 which communicate with the internal bore 115 thereof. The chamber 106 includes a port 116 for the supply of hydraulic fluid whilst a further port 117 communicates with the chamber 100 for venting fluid therefrom.

Located with in the bore 115 is a slide valve member 118 arranged for reciprocation within the bore 115 and including spaced lands 119, 120 and 121 separated by annular grooves 122 and 123. A return spring 124 is located within the bore 115 to engage the slide valve 118, the latter being centrally bored at 125 to define a vent terminating in a port 126 for venting the end of the bore 115 so as to permit spring operation.

The end of the slide valve 118 may be fitted with an end cap 127 which serves for clearance adjustment as a cam follower for engagement with a rotatable cam 128 on a cam shaft 129. The piston assembly 102 is coupled to the piston 95 for movement therewith.

Figure 28:
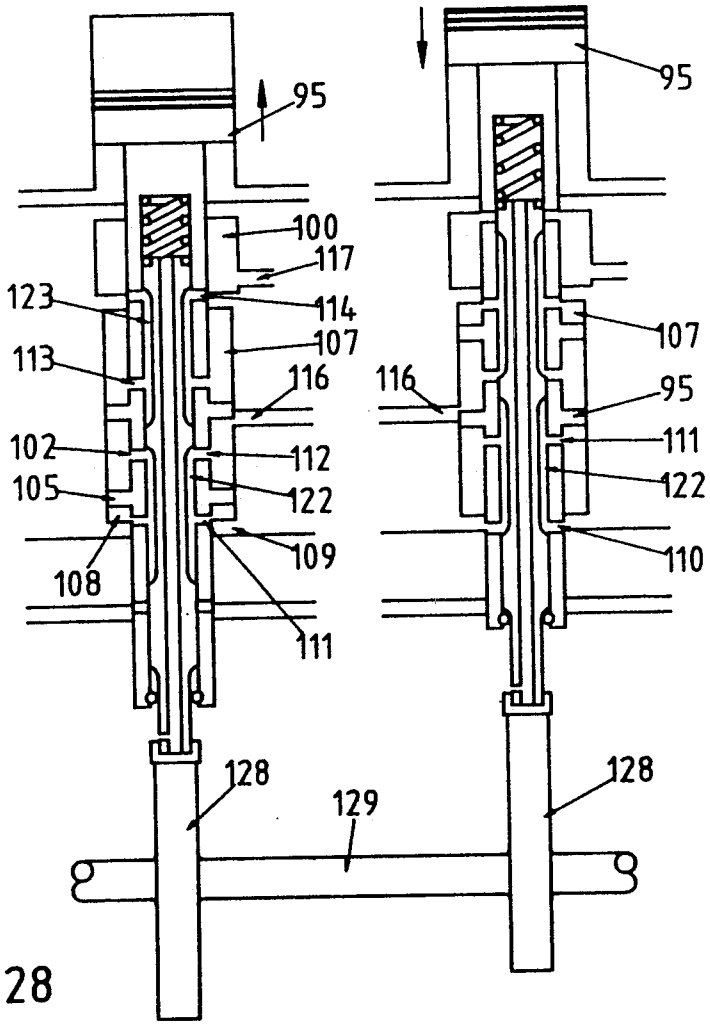
FIGS. 28 illustrates a pair of cylinders of an internal combustion engine showing the pistons at opposite ends of their strokes.

In use and assuming the piston 95 is at the lower end of its stroke within the cylinder 96 as shown in FIG. 28 and that the engine of which the cylinder 96 is a part is a four cycle engine, the cam shaft 129 is rotated so that the cam 128 moves the slide valve member 118 within the bore 115 so that hydraulic fluid is supplied through the port 116 to pass into the chamber 106, port 112, groove 122 and port 111 into the chamber 108. This will cause the piston assembly 102 to be driven upwardly because the fluid acts between the piston 105 and end wall 109. At the same time fluid in the chamber 107 is vented through port 113, groove 123, port 114 and chamber 100 into the vent port 117. The piston 95 will thus be driven upwardly compressing the charge which has been supplied into the cylinder 96.

Ignition of the charge within the cylinder 96 drives the piston 95 and the coupled piston assembly 102 downwardly from the top position as shown on the right hand side of FIG. 28, whilst at the same time the cam 128 has advanced the slide valve 118 thereby closing communication between the supply port 116 and chamber 108 and causing fluid in that chamber to be forced out upon downward movement of the piston 95 through the port ill, groove 122 and port 110 where it is directed to do useful work for example for driving an hydraulic motor and thence return to a reservoir to be stored for future use. At the same time communication is opened between the port 116 and chamber 107 so that hydraulic fluid is admitted thereto.

Figure 29:
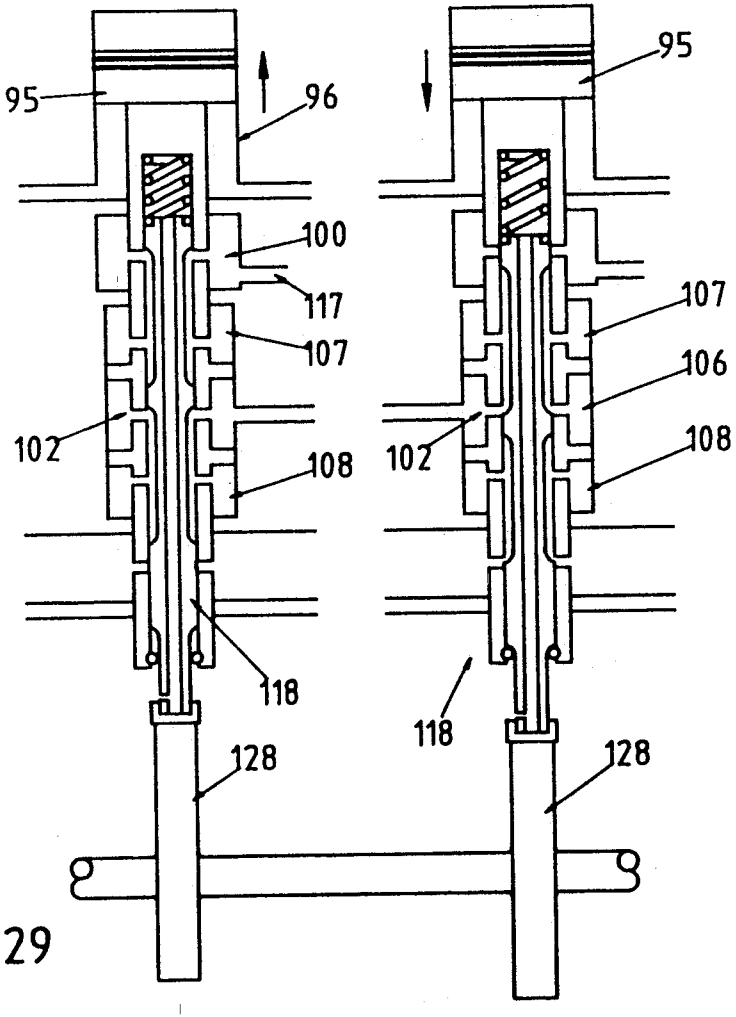
FIG. 29 illustrates the pair of cylinders of FIG. 28 at the middle of the reciprocating strokes of the pistons.

Movement of the slide valve member 118 again by the cam 128 as shown on the left hand side of FIG. 29 again causes fluid to be admitted to the chamber 108 so that the piston assembly 102 is displaced upwardly causing the piston 95 to rise in cylinder 96 thereby causing exhaust gases therein to be discharged through an exhaust valve of the cylinder 96 in conventional fashion. At the same time, the valve 118 opens communication between the chamber 107 and chamber 100 so that hydraulic fluid is forced from chamber 107 and through the outlet port 117 where again it may be directed to do useful work.

Movement of the cam 128 then causes movement of the slide valve 118 to be reversed so that again fluid is directed from the chamber 106 into the chamber 107 whilst chamber 108 is vented through the port 110. This causes the piston assembly 102 to retract as shown on the right hand side of FIG. 29 carrying with it the piston 95 which serves to draw in through the inlet valve of the cylinder 96 a fresh cylinder charge.

Figure 30:
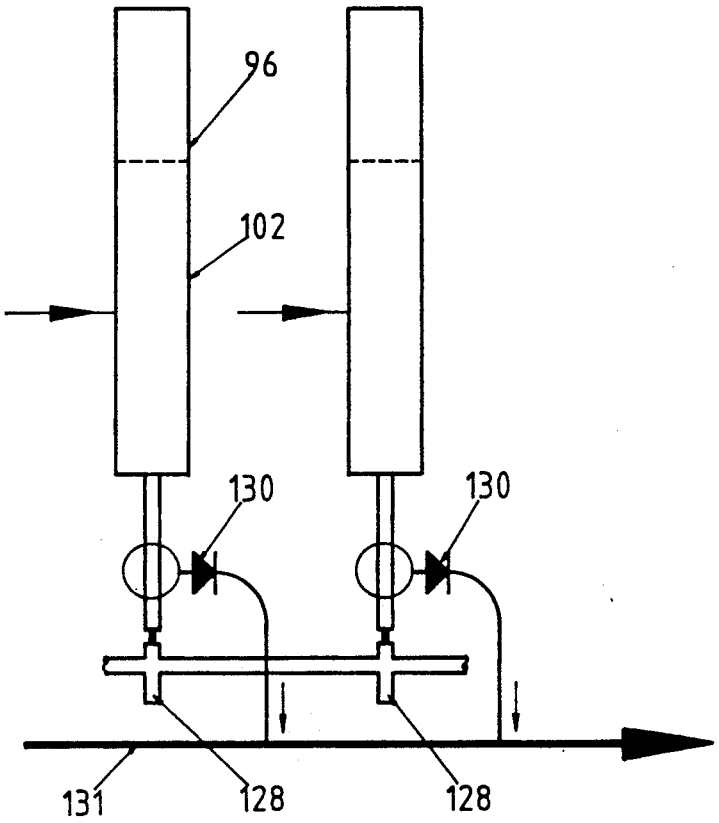
FIG. 30 illustrates a pair of cylinders of an internal combustion engine supplying fluid to a high pressure gallery.
Figure 31:
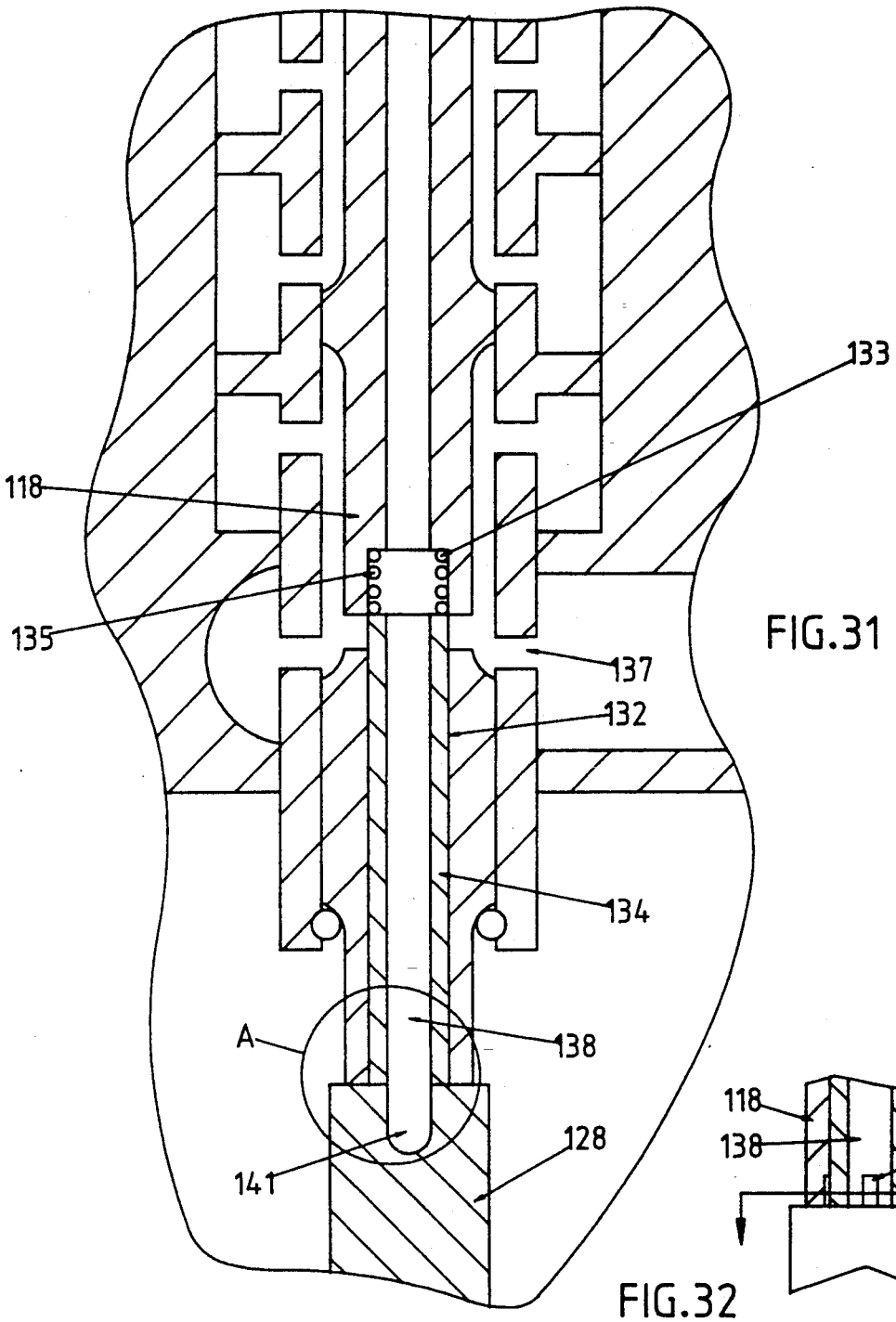
FIG. 31 illustrates a preferred auxiliary valving arrangement for overcoming misfiring in a cylinder and engaging idle cylinders.

A plurality of cylinders 96 and associated actuators may be arranged as shown in FIG. 30 with the outlets ports 110 being connected via one way valves 130 to a high pressure gallery 131 for supplying hydraulic fluid for driving a pump or other load. The slide valve member 118 is provided with a bore 132 stepped at 133 and located within the bore 132 is a secondary slide valve member 134 which operates against a return spring 135 interposed between one end of the valve 134 and the step 133.

The slide valve member 134 normally reciprocates in unison with the slide valve member 118 under the influence of the cam 128. A port 137 is provided in the slide valve member 118 for communication with the bore 132 with communication of the port 137 with the bore 132 being controlled by the slide valve member 134. The slide valve member 134 is also centrally bored at 138, this bore comprising a fluid passageway normally venting the main spring chamber of the slide valve member 118 and also comprising a passageway for venting fluid from the chamber 108.

Figure 32:
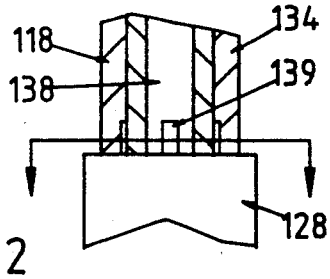
FIG. 32 illustrates in elevational view details of an alternative drainage port arrangement in the area A of FIG. 31.
Figure 33:
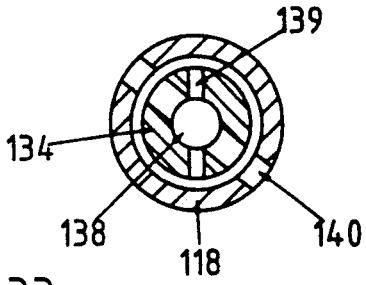
FIG. 33 is a sectional view along lines B—B of FIG. 32

The slide valve member 134 as shown in FIGS. 32 may be provided with channels 139 for discharge of hydraulic fluid from the bore 138, these channels communicating with channels 140 formed in the lower end of the slide valve 118. Alternatively or additionally, the cam 128 may be formed with an annular groove 141 communicating with the bore 138 for discharge of hydraulic fluid.

In the event of a misfire, the non-return valve 130 associated with the misfiring cylinder 96 isolates the misfiring cylinder from the high pressure gallery 131. Fluid pressure however is maintained in the chamber section 108 with this pressure being insufficient to overcome the pressure in the gallery 31 and cause the valve 130 to open, and thus the piston 95 will be unable to return from its top position after having been moved to that position by the piston assembly 102. The cam 128 however will continue rotating so that the slide valve member 134 under the urging of the spring-135 opens the port 137 so that fluid may drain therefrom through the bore 138 and either through the groove 141 or ports 139 and 140. This will permit the piston 95 to return to a lower position for the next upward stroke.

In the arrangement described above, the piston 95 undergoes a conventional four stroke cycle however it may readily be adapted for undergoing a two stroke cycle by providing appropriate exhaust ports in the cylinder 96. Furthermore, rather than extracting the hydraulic discharge for performing work, the hydraulic discharge may be utilised for the supply of auxiliary power and operation of the pistons only whilst the power to do useful work is extracted from the discharge gases of combustion by their passage through for example a turbine. In this form, the engine will be working in a form equivalent to a free piston engine without the disadvantages associated therewith.

Figure 34:
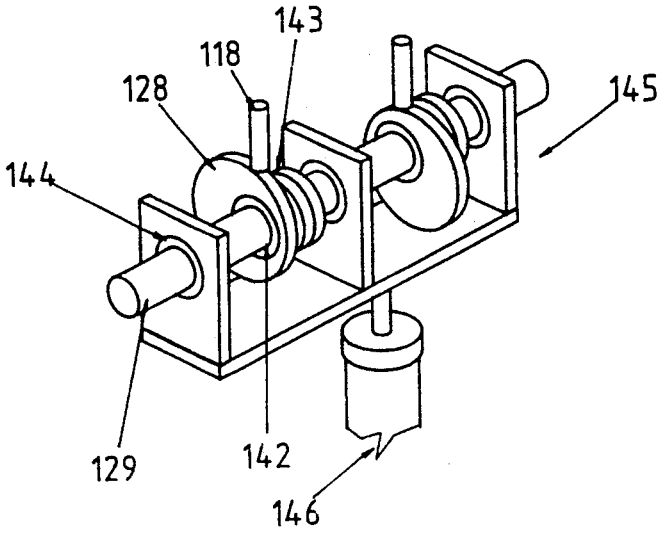
FIG. 34 illustrates in perspective view an arrangement for controlling the compression ratio of the cylinder of FIG. 28.

Referring now to FIG. 34, there is illustrated an arrangement for varying the compression ratio in a cylinder In the embodiment illustrated, the cam shaft 129 carries cams 128 for operating slide valves members 118 through the extended stems 118', the cams 128 being rotatably supported via bearings 142 on the shaft 129 but which may be engaged for rotational movement with the shaft 129 by means of indexing clutch assemblies 143 such as a dog clutch which may be selectively engaged or disengaged by means of any suitable actuator such as an hydraulic ram or other device actuated by hydraulic pressure. As shown the shaft 129 is supported in bearings 144 in a frame 145, the latter being supported for adjustable movement in a vertical direction by means of, for example, a ram 146. Extension of the ram 146 will cause elevation of the frame 145 so as to cause raising of the piston assembly 102 and piston 95 within the cylinder 96 thereby resulting in a cylinder which has the same working stroke but a higher compression ratio when the piston 95 is reciprocated. Alternatively, retraction of the ram 146 will cause lowering of the compression ratio.

Figure 35:
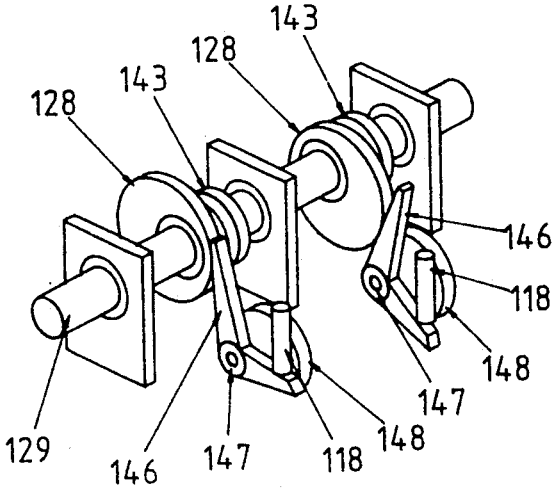
FIG. 35 illustrate in perspective view an arrangement for controlling the stroke of the piston of the engine.

In the arrangement of FIG. 35, the cam shaft 129 is offset from operating stems 118' for the slide valves members 118 and again the cams 128 may be selectively engaged by the clutches 143. Reciprocatory movement of the slide valves 118 occurs via bell cranks 146, the latter being pivotally mounted at 147 on eccentrics 148. Rotation of the eccentrics will cause displacement of the pivotal mounts 147 of the bell cranks altering the ratios of leverage and thus the amount of movement transmitted to the valve stems 118' upon rotation of the cams 128. This arrangement thus permits selective alteration of the stroke and compression ratio of the piston 95 within the cylinder 96.

Figure 36:
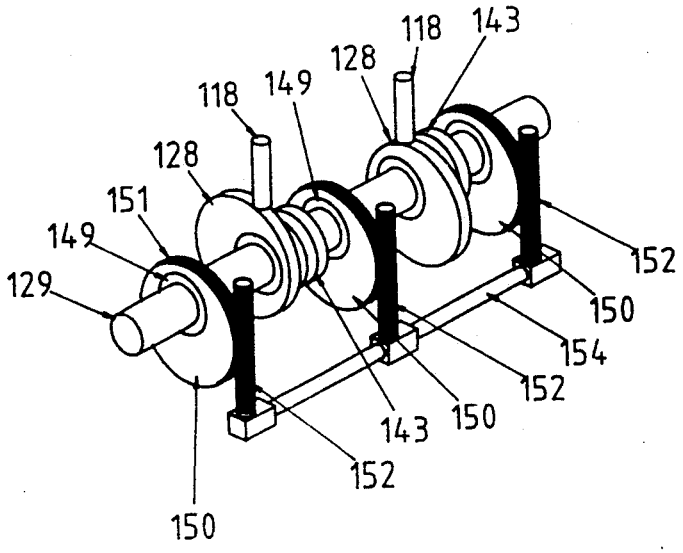
FIG. 36 illustrates an alternative arrangement for controlling the engine compression ratio.

In FIG. 36, the shaft 129 is supported rotatably via bearings 149 and eccentrically on respective spaced eccentric members 150, the latter being mounted rotatably in the engine frame. Again indexing clutches 143 are employed to enable selective engagement of the cams 128 with the shaft 129. The eccentric members 150 are externally threaded at 151 and engaged by respective screw threaded spindles 152, the latter of which may be coupled via gearboxes 153 to a single adjustment shaft 154. Rotation of the shaft 154 will be transferred into rotation of the spindles 152 and thus rotation of the members 150 thereby altering the position of the shaft 129 relative to the valve stems 118'. This thereby serves to vary the stroke of the piston 95 and the compression ratio. In each of the above arrangements, selected cylinders may be isolated in the case of damage by simply disengaging the indexing 143 whilst continuing to operate the engine.

The cams 128 may alternatively be fixedly mounted to the shaft 129 or formed integrally with the shaft 129 so as to always rotate with the shaft and be carried in bearings about the shaft rigidly mounted to the engine frame. Alternatively, the shaft may be mounted as described in FIGS. 34, FIG. 35 or FIG. 36.

The present invention thus provides a fluid actuator which has many applications and which is particularly suited to use in controlling various functions at motor vehicles. Movement of the slide valve member in opposite directions causes corresponding slaved movement of the piston assembly so that the actuator of the present invention is particularly suited to servomechanism type applications.

Many modifications and variations to the invention as would be apparent to persons skilled in the art may be made thereto without departing from the broad scope and ambit thereof as herein set forth. For example, different valving configurations may be employed other than the slide valve arrangement illustrated. Furthermore, whilst the actuator of the invention is primarily suited to be driven by liquid such as hydraulic fluid, it may readily be adapted to be driven by gases or air.

I claim:

1. A fluid actuator including a chamber, a piston assembly arranged for reciprocating movement within said chamber, said piston assembly including first and second spaced apart pistons dividing said chamber into a first chamber section between said first piston and said chamber, a second chamber section between said first and second pistons, and a third chamber section between said second piston and said chamber, passageway means in said piston assembly, fluid inlet means communicating with said second chamber section and valve means for controlling the flow of fluid through said passageway means, said valve means being operable to communicate fluid through said passageway means from said second to said first chamber sections so as to cause movement of said piston assembly in a first direction, and said valve means being further operable to communicate fluid through said passageway means from said second to said third chamber sections so as to cause said piston assembly to move in a direction opposite said first direction.

2. In combination, a fluid actuator as defined in claim 1 and a fuel injector having a reciprocal plunger, said piston assembly being coupled to said plunger and being adapted to reciprocate said plunger upon operation of said valve means.

3. A fluid actuator according to claim 1, wherein said piston assembly includes first, second and third port means communicating with said first, second and third chamber sections respectively and wherein said valve means controls communication between said port means and said passageway means.

4. A fluid actuator according to claim 3 wherein said piston assembly includes opposite portions extending beyond opposite ends of said chamber, vent port means in said opposite portions and adapted for communication with said passageway means, said valve means being adapted to control communication of said vent port means with said first and third port means whereby to control venting of said first and third chamber sections.

5. A fluid actuator according to claim 4 wherein said passageway means comprise a passageway extending longitudinally of said piston assembly and wherein said valve means is slidable in said passageway.

6. A fluid actuator according to claim 5 wherein said valve means includes a plurality of lands, said lands being adapted to open and close said port means to control communication thereof with said passageway.

7. A fluid actuator according to claim 6 wherein said lands are separated by annular grooves defining fluid paths in said passageway.

8. A fluid actuator according to claim 4 wherein movement of said valve means in said first direction opens communication between said first and second port means via said passageway means, and opens communication between said third port means and vent port means via said passageway means to cause said movement of said piston assembly in said first direction.

9. A fluid actuator according to claim 8 wherein movement of said valve means in said opposite direction opens communication between said second and third port means via said passageway means, and opens communication between said first port means and vent port means via said passageway means to cause movement of said piston assembly in said opposite direction.

10. A fluid actuator according to claim 4 and including further chamber sections communicating with the respective said vent port means and isolating vented fluid.

11. A fluid actuator according to claim 1 and including biasing means for opposing movement of said piston assembly in said first direction.

12. A fluid actuator according to claim 11 wherein said biasing means acts on said second piston.

13. A fluid actuator according to claim 12 wherein said biasing means comprising spring means disposed between said second piston and wall means at the other end of said chamber.

14. In combination a fluid actuator as defined in claim 1 and a valve of an internal combustion engine, said piston assembly being coupled to said engine valve and wherein movement of said operation of said valve means is adapted to cause opening and closing movement of said valve.

15. The combination of claim 14 wherein said engine valve includes a valve stem, said piston assembly being secured to or formed integrally with said stem and said passageway being disposed within said stem.

16. An internal combustion engine comprising a piston reciprocable in a cylinder and a fluid actuator as defined in claim 1, said piston assembly of said actuator being coupled to said engine piston and wherein operation of said valve means causes reciprocation of said piston assembly and said engine piston.

17. An internal combustion engine according to claim 16 wherein said valve means is operated by cam means, rotation of said cam means causing reciprocation of said valve means and said piston assembly.

18. An internal combustion engine according to claim 16, wherein operation of said valve means causes said engine piston to undergo a compression stroke and a fuel intake stroke, respectively.

19. An internal combustion engine according to claim 18, wherein said fluid actuator includes fluid outlet means, said valve means controlling fluid communication between said fluid outlet means and said first and third chamber sections, said fluid outlet means receiving fluid from said first and third chamber sections on movement of said piston assembly in opposite directions.

20. An internal combustion engine according to claim 19, wherein said fluid outlet means are connected to a high pressure fluid gallery via non-return valve means for supplying fluid to a load.

21. An internal combustion engine according to claim 20, wherein said fluid actuator includes secondary valve means, said secondary valve means venting fluid from said third chamber section in the event of misfiring in said engine cylinder in an advanced position of said engine piston so as to permit said piston assembly of said fluid actuator and said piston of said engine to retract from said advanced position.

22. An internal combustion engine according to claim 17, wherein said cam means are mounted on a rotating shaft and there being provided means for selectively engaging said cam means with said shaft so as to allow rotation of said cam means with said shaft.

23. An internal combustion engine according to claim 17, wherein said cam means are mounted for movement towards and away from said valve means so as to vary the compression ratio of said engine while maintaining the stroke of said engine piston.

24. An internal combustion engine according to claim 17, and including crank means between said cam means and said valve means and means for varying the position of said crank means relative to said valve means to vary the stroke of said engine piston and compression ratio of said engine.

* * * * *